US006904836B1

(12) United States Patent
Andrei

(10) Patent No.: US 6,904,836 B1
(45) Date of Patent: Jun. 14, 2005

(54) SCREW HOLDING SCREWDRIVER ADAPTER

(76) Inventor: Petru Andrei, Str. Oltului Nr. 20, Bloc B17, AP, 50, Galati, 6200 (RO)

( * ) Notice: Subject to any disclaimer, the term of this patent is extended or adjusted under 35 U.S.C. 154(b) by 318 days.

(21) Appl. No.: 10/061,767

(22) Filed: Feb. 1, 2002

(51) Int. Cl.[7] ..... B25B 23/08
(52) U.S. Cl. ..... 81/452; 81/444
(58) Field of Search ..... 81/452, 453, 458, 81/441–444, 448

(56) References Cited

U.S. PATENT DOCUMENTS

| | | | | | |
|---|---|---|---|---|---|
| 522,640 | A | | 7/1894 | White | |
| 595,859 | A | * | 12/1897 | Miller | 81/444 |
| 881,298 | A | * | 3/1908 | Chappel | 81/452 |
| 896,107 | A | | 8/1908 | Harrison | |
| 925,115 | A | * | 6/1909 | Loewenberg | 81/438 |
| 955,520 | A | * | 4/1910 | Loewenberg | 81/440 |
| 1,075,225 | A | * | 10/1913 | Reamy | 81/443 |
| 1,394,438 | A | * | 10/1921 | Mills | 81/444 |
| 1,624,530 | A | * | 4/1927 | Caruso | 81/438 |
| 1,742,278 | A | * | 1/1930 | Reid | 81/443 |
| 1,779,339 | A | * | 10/1930 | Sokoloff | 81/452 |
| 1,945,829 | A | * | 2/1934 | Sofield | 81/444 |
| 1,969,615 | A | * | 8/1934 | Kmet | 81/444 |
| 2,227,466 | A | * | 1/1941 | Runge | 81/444 |
| 2,313,710 | A | * | 3/1943 | Gemmell | 81/444 |
| 2,404,427 | A | * | 7/1946 | Bloomfield | 81/443 |
| 2,492,576 | A | | 12/1949 | James | |
| 2,497,256 | A | * | 2/1950 | Carlson | 81/452 |
| 2,506,922 | A | * | 5/1950 | Hansen | 81/444 |
| 2,559,206 | A | * | 7/1951 | Weinholtz | 81/444 |
| 2,562,347 | A | * | 7/1951 | Young | 81/444 |
| 2,625,971 | A | * | 1/1953 | Bier | 81/444 |
| 2,657,724 | A | * | 11/1953 | Shaff | 81/444 |
| 2,737,988 | A | * | 3/1956 | Gearhart et al. | 81/438 |
| 2,781,807 | A | * | 2/1957 | Labbee, Jr. | 81/444 |
| 2,890,733 | A | * | 6/1959 | Valiulis | 81/442 |
| 2,954,809 | A | * | 10/1960 | Loewy | 81/452 |
| 3,150,698 | A | * | 9/1964 | Neil | 81/444 |
| 3,753,454 | A | | 8/1973 | Totsu | |
| 3,810,502 | A | * | 5/1974 | Kyser | 81/443 |
| 3,825,048 | A | * | 7/1974 | Triska | 81/444 |
| 5,515,755 | A | * | 5/1996 | Kung | 81/452 |

* cited by examiner

*Primary Examiner*—David B. Thomas
(74) *Attorney, Agent, or Firm*—Parsons & Goltry; Robert A. Parsons; Michael W. Goltry

(57) ABSTRACT

A screw holding screwdriver adapter includes first and second elongated mating elements held together by a mounting member. The mounting member engages the elongated mating elements in an opposed relationship so as to define a screwdriver shank engaging portion between the first ends with the second ends cooperating to define a screw engaging portion. The first and second elongated mating elements and the mounting member further define a screwdriver blade and shank receiving opening therein. The screw engaging portion is formed to fit easily in the slot of a screw and to expand, when the blade of a screwdriver is inserted between the second ends, to grip the screw until the screw can be partially engaged in a desired opening. The adapter can then be slid up the screwdriver shank or removed from the screwdriver and the screw is mounted in a normal fashion.

13 Claims, 2 Drawing Sheets

10
12
13
14
15
18
19
20
22
23
24
25

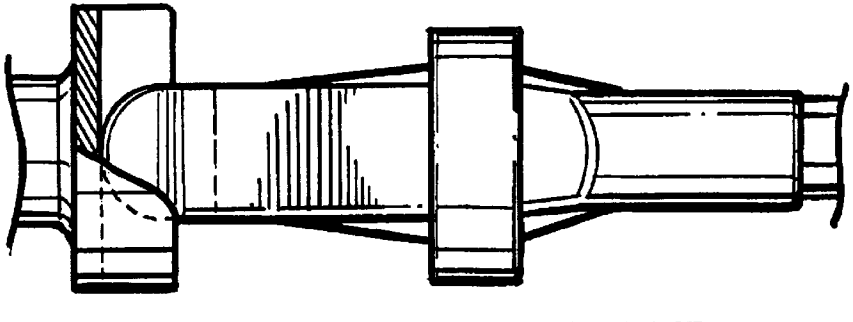
FIGURE 4
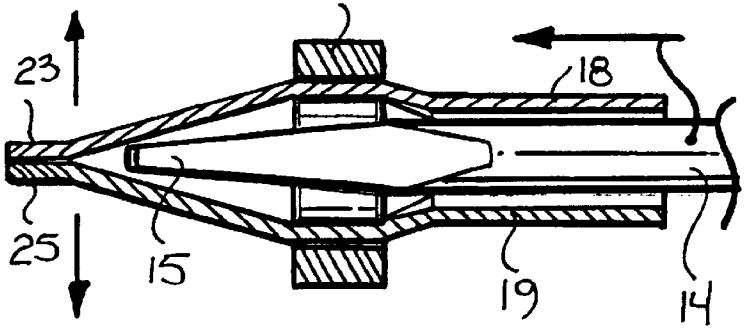
FIGURE 5
FIGURE 6

SCREW HOLDING SCREWDRIVER ADAPTER

FIELD OF THE INVENTION

This invention relates to hand tools.

More particularly, the present invention relates screwdrivers.

In a further and more specific aspect, the instant invention concerns devices for holding a screw to a screwdriver.

BACKGROUND OF THE INVENTION

Tools for driving screws, namely screwdrivers, are well known and have long been used. While no better tool has been developed for driving screws, an age old problem with screwdrivers has been temporarily affixing the screw to the blade of the screwdriver in some manner. Often an individual grips the screwdriver in one hand and hold the screw onto the blade with the other hand. While this method works and has been used since screwdrivers first appeared, it can be awkward as it eliminates a free hand which could be used for other purposes. Also, in many situations it is difficult to reach into obstructed areas so as to position a hand to hold the screw. Many devices have been developed to overcome this problem. For example, the blade of the screwdriver can be magnetized to attract and hold the screw in position. This method is less than adequate however, and the magnetic field is relatively weak and does not securely retain the screw.

It would be highly advantageous, therefore, to remedy the foregoing and other deficiencies inherent in the prior art.

Accordingly, it is an object of the present invention to provide a new and improved screwdriver adapter.

Another object of the invention is to provide apparatus for temporarily affixing a screw to the blade of a screwdriver.

And another object of the invention is to provide a screw holding adapter that can be mounted on a screwdriver.

SUMMARY OF THE INVENTION

Briefly, to achieve the desired objects of the instant invention in accordance with a preferred embodiment thereof, provided is a screw holding screwdriver adapter including first and second elongated mating elements held together by a mounting member. The mounting member engages the elongated mating elements in an opposed relationship so as to define a screwdriver shank engaging portion between the first ends with the second ends cooperating to define a screw engaging portion. The first and second elongated mating elements and the mounting member further define a screwdriver blade and shank receiving opening therein.

In operation, the blade and shank of a screwdriver are inserted into the screwdriver blade and shank receiving opening. The screwdriver shank engaging portion of the adapter grips the shank of the screwdriver with the blade of the screwdriver disengaged from the screw engaging portion. The screw engaging portion is formed to fit easily in the slot of a screw and to expand, when the blade of the screwdriver is inserted between the second ends. The outer surfaces of the second ends at the screw engaging portion grip the surfaces of the screw slot until the screw can be partially engaged in a desired opening. The adapter can then be disengaged from the screw slot and slid up the screwdriver shank or removed from the screwdriver. The screw is then mounted or inserted (screwed in) in a normal fashion using the blade of the screwdriver.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 4 is an enlarged sectional side view of the screw holding adapter in association with the blade of the screwdriver;

FIG. 5 is an enlarged top plan view of the screw holding adapter engaged in the slot of a screw, portions thereof broken away and shown in section; and FIG. 6 is an enlarged side view of the screw holding adapter engaged in the slot of a screw, portions thereof broken away and shown in section.

DETAILED DESCRIPTION OF THE PREFERRED EMBODIMENT

Figures 1, 2, 3:
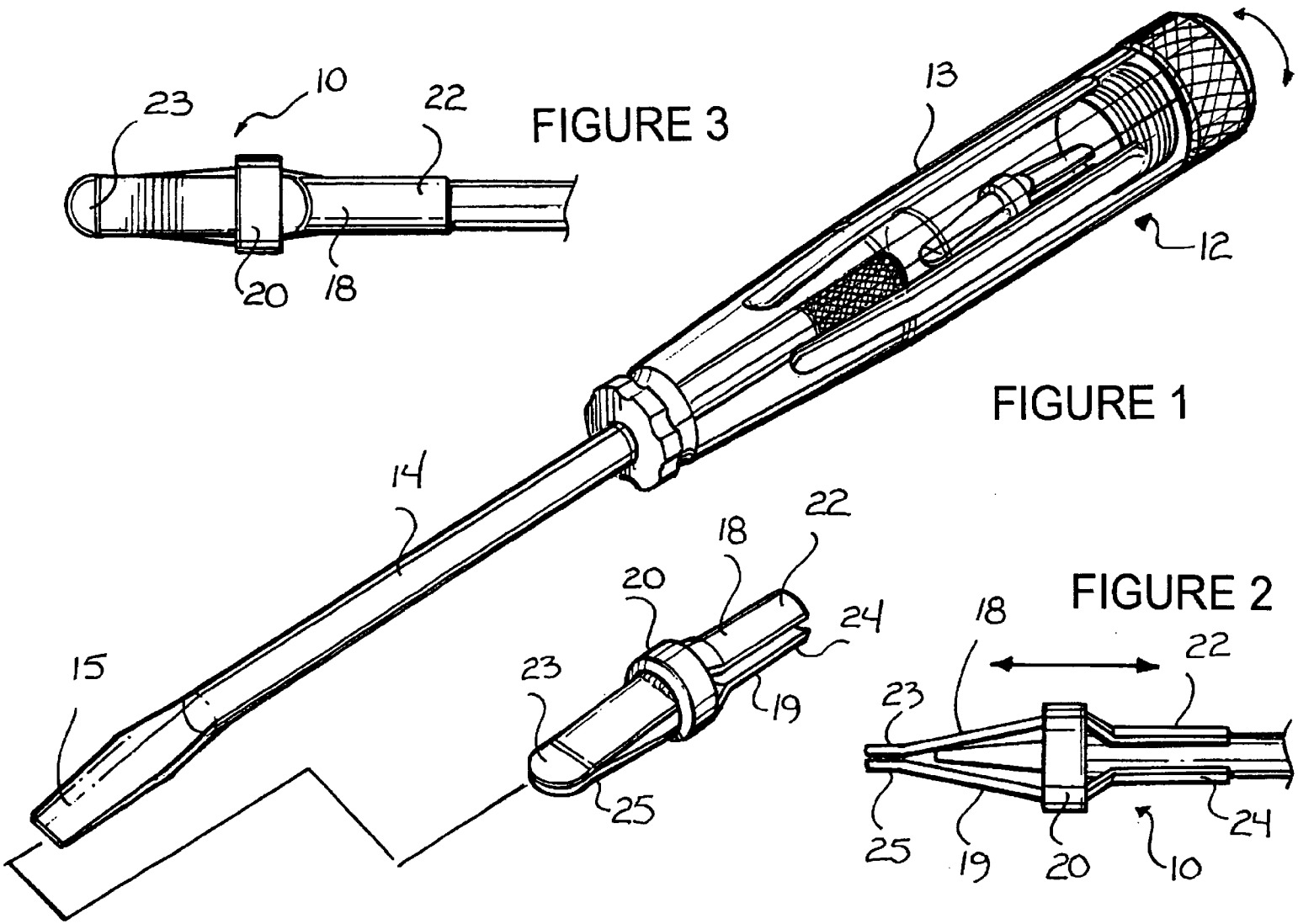
FIG. 1 is an exploded perspective view illustrating a screwdriver with unattached screw holding adapter, according to the present invention.
FIG. 2 is a side elevation view of the screw holding adapter of FIG. 1 as it appears carried by the blade of the screwdriver.
FIG. 3 is a top plan view of the screw holding adapter of FIG. 1 as it appears carried by the blade of the screwdriver.

Turning now to the drawings in which like reference characters indicate corresponding elements throughout the several views, attention is first directed to FIGS. 1, 2, and 3, which illustrate a screwdriver adapter 10 and screwdriver 12 in accordance with the present invention. Screwdriver 12 includes a handle 13, a shaft 14, and a blade 15. As will be understood from the following description, virtually any of the various types of screwdrivers can be utilized in conjunction with adapter 10 and the type illustrated is only for exemplary purposes.

Adapter 10 includes first and second elongated mating elements 18 and 19 held in an opposing relationship by a mounting member 20. Element 18 has a first end 22 and a second end 23 and element 19 has a first end 24 and a second end 25. Mating elements 18 and 19 are held in an opposed relationship by mounting member 20 so as to define a screwdriver shank engaging portion between first ends 22 and 24. Second ends 23 and 25 cooperate to define a screw engaging portion. Further, mating elements 18 and 19 and mounting member 20 define a screwdriver blade and shank receiving opening therein.

In this specific example, mating elements 18 and 19 define opposed substantially arcuate portions of a common cylinder between screwdriver shank engaging ends 22 and 24. Second ends 23 and 25 each define inner and outer planar surfaces and, in an unused orientation (see FIG. 2), mounting member 20 holds second ends 23 and 25 with the inner planar surfaces in flat abutting engagement. Also, the outer planar surfaces of second ends 23 and 25 are formed to fit easily in the slot of a screw. At least second ends 23 and 25 of mating elements 18 and 19 are formed of resilient material to allow limited transverse 11 movement upon the at least partial insertion of a screwdriver blade between the second ends (as illustrated in FIG. 6). In the example illustrated, ends 23 and 25 of mating elements 18 and 19 are rounded slightly so they can be easily inserted into substantially any type of screw slot. It will of course be understood that other types or shapes of ends 23 and 25 may be incorporated in specific applications to more easily be inserted in and to grip substantially any type of screw.

In this embodiment, mating elements 18 and 19 are fixedly held in position by a ring shaped mounting member 20. It will of course be understood that mating elements 18 and 19 and mounting member 20 can be formed as three separate components and affixed together by some convenient means, such as welding, soldering, gluing, etc. Also, while mounting member 20 is illustrated as having a ring shape, it will be understood that many other configurations are possible, as long as mating elements 18 and 19 are held in the desired position and screwdriver 12 can be inserted into the defined opening. In a different embodiment, mating elements 18 and 19 and mounting member 20 can be formed of a hard plastic or the like and could be molded as one integral unit. To increase the durability of a plastic adapter, at least tips 23 and 25 could be metalized (i.e., covered with metal) or could included metal tips molded into mating elements 18 and 19.

In the preferred embodiment, mating elements 18 and 19 are formed of resilient material, (e.g., metal such as spring steel) and the screwdriver shank engaging portion expands transversely to receive screwdriver shank 14 between first ends 22 and 24. After insertion of screwdriver blade 15 and shank 14, the screwdriver shank engaging portion contracts to grip screwdriver shank 14, as illustrated in FIG. 2. Also, in the preferred embodiment, the portion of mating elements 18 and 19 immediately adjacent second ends 23 and 25 is tapered or angled gradually outwardly so that as adapter 10 is moved rearwardly along shaft 14 of screwdriver 12, blade 15 of screwdriver 12 gradually forces ends 23 and 25 apart.

Referring to FIGS. 4, 5, and 6, slightly enlarged views of screwdriver 12 engaged in adapter 10 are illustrated. Also, a typical screw 30 is illustrated with adapter 10 engaged in slot 31 thereof (see FIG. 6). To more clearly explain the operation, blade 15 and shank 14 of screwdriver 12 are inserted into the screwdriver blade and shank receiving opening defined within mating elements 18 and 19, as illustrated in FIG. 4. The screwdriver shank engaging portion of adapter 10 grips shank 14 of screwdriver 12 with blade 15 disengaged from the screw engaging portion. The screw engaging portion is formed with planar inner and outer surfaces to fit easily in slot 31 of screw 30.

With ends 23 and 25 (the screw engaging portion) positioned in slot 31 of screw 30, screwdriver 12 is moved axially within adapter 10 so that blade 15 is inserted at least slightly between ends 23 and 25. The portion of mating elements 18 and 19 immediately adjacent second ends 23 and 25 is tapered or angled gradually outwardly so that as relative movement between adapter 10 and shaft 14 of screwdriver 12 occurs, blade 15 of screwdriver 12 gradually forces ends 23 and 25 apart. The outer surfaces of second ends 23 and 25 (the screw engaging portion) grip the surfaces of screw slot 31 temporarily engaging screw 30 with screwdriver 12. Screw 30 can than easily be partially engaged in a desired opening or any receiving material. Adapter 10 can then be disengaged from screw slot 31 and slid up screwdriver shank 14 or removed completely from screwdriver 12. Screw 30 is then mounted or inserted (screwed in) in a normal fashion using blade 15 of screwdriver 12.

Thus, a screw holding adapter has been disclosed for use with a screwdriver. The adapter can be quickly and easily engaged with a screw to temporarily hold the screw for partial insertion into a screw receiving hole or material. Once the screw is started, the adapter can quickly and easily be moved so that the screwdriver can be used to set the screw in a normal operation. Because the adapter is not actually used to set the screw, it can be constructed of lighter and less expensive material. Also, the adapter holds the screw firmly and positively for the initial start and then is easily moved to allow normal functioning of the screwdriver.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A screw holding screwdriver adapter comprising:

first and second elongated mating elements, each element having a first end and a second end; and a mounting member engaging the first and second elongated mating elements in an opposed relationship so as to define a screwdriver shank engaging portion between the first ends and the second ends cooperating to define a screw engaging portion, the first and second elongated mating elements and the mounting member further defining a screwdriver blade and shank receiving opening therein, at least the second ends of the mating elements being formed of resilient material to allow limited transverse movement of the second ends upon the at least partial insertion of a screwdriver blade between the second ends, the mating elements and the mounting member are formed of hard plastic with at least the second ends of the mating elements including metal.

2. A screw holding screwdriver adapter as claimed in claim 1 wherein the mating elements define opposed substantially arcuate portions of a common cylinder between the screwdriver shank engaging ends.

3. A screw holding screwdriver adapter as claimed in claim 1 wherein the mating elements define substantially flat surfaces on opposite outwardly facing sides of the second ends.

4. A screw holding screwdriver adapter as claimed in claim 1 wherein the mounting member is fixedly attached to an outer surface of each of the mating elements.

5. A screw holding screwdriver adapter as claimed in claim 4 wherein the mounting member is formed in a generally ring shape.

6. A screw holding screwdriver adapter as claimed in claim 1 wherein the mating elements are formed of resilient metal and the screwdriver shank engaging portion expands transversely to receive a screwdriver shank between the first ends and contracts to grip the screwdriver shank.

7. A screw holding screwdriver adapter as claimed in claim 1 wherein the second ends each define inner and outer planar surfaces and, in an unused orientation, the mounting member holds the second ends with the inner planar surfaces in flat abutting engagement, the outer planar surfaces cooperating to be inserted in a screw slot.

8. A screw holding screwdriver adapter as claimed in claim 1 wherein the mating elements each have a portion immediately adjacent the second end that is tapered or angled transversely outwardly as it extends from the second end toward the first end.

9. A screw holding screwdriver adapter comprising:

first and second elongated mating elements, each element having a first end and a second end;

a mounting member engaging the first and second elongated mating elements in an opposed relationship so as to define a screwdriver shank engaging portion between the first ends and the second ends cooperating to define a screw engaging portion, the first and second elongated mating elements and the mounting member further defining a screwdriver blade and shank receiving opening therein;

the second ends each defining inner and outer planar surfaces and, in an unused orientation, the mounting member holding the second ends with the inner planar surfaces in flat abutting engagement, the outer planar surfaces cooperating to be inserted in a screw slot; and the mating elements being formed of resilient material to allow limited transverse movement of the first and second ends upon the insertion of a screwdriver blade and shank therebetween, the screwdriver shank engaging portion expanding transversely to receive a screwdriver shank between the first ends and contracting to grip the screwdriver shank, and the second ends expanding transversely to grip the inner surfaces of a screw slot, the mating elements and the mounting member are formed of hard plastic with at least the second ends of the mating elements including metal.

10. A screw holding screwdriver adapter as claimed in claim 9 wherein the mating elements define opposed substantially arcuate portions of a common cylinder between the screwdriver shank engaging ends.

11. A screw holding screwdriver adapter as claimed in claim 9 wherein the mounting member is fixedly attached to an outer surface of each of the mating elements.

12. A screw holding screwdriver adapter as claimed in claim 11 wherein the mounting member is formed in a generally ring shape.

13. A screw holding screwdriver adapter as claimed in claim 9 wherein the mating elements each have a portion immediately adjacent the second end that is tapered or angled transversely outwardly as it extends from the second end toward the first end.

* * * * *